United States Patent [19]

Ollat

[11] Patent Number: 4,906,042

[45] Date of Patent: Mar. 6, 1990

[54] DEVICE FOR LOCKING, IN ANY ONE OF THE NOTCHES OF A RACK, AN ADJUSTING FINGER AND ARMCHAIR EMPLOYING SAID DEVICE

[75] Inventor: Marc Ollat, Oyonnax, France

[73] Assignee: Grosfillex S.A.R.L., Oyannax, France

[21] Appl. No.: 383,874

[22] Filed: Jul. 21, 1989

[30] Foreign Application Priority Data

Aug. 4, 1988 [FR] France ..... 88 10587

[51] Int. Cl.[4] ..... A47C 4/00

[52] U.S. Cl. ..... 297/19; 297/26; 297/28

[58] Field of Search ..... 297/19, 24–28, 297/359, 345

[56] References Cited

FOREIGN PATENT DOCUMENTS 3322788 1/1984 Fed. Rep. of Germany ..... 297/19

1514352 1/1968 France ..... 297/19

*Primary Examiner*—Francis K. Zugel

*Attorney, Agent, or Firm*—Weingarten, Schurgin, Gagnebin & Hayes

[57] ABSTRACT

This invention relates to a device for locking an adjusting finger in any one of the notches of a rack, wherein the first mobile element provided with the rack defines windows for the passage of retractable stops capable of being placed opposite the notches to stop the finger of the second mobile element, these stops being located at the free ends of flexible arms inclined in herringbone fashion and integral at their other ends with a sliding element provoking, when it is actuated, bending of said arms which abut on an edge of the windows and thus retraction of the stops.

10 Claims, 4 Drawing Sheets

14
11
13
4
19
20
10
III
IV
IV
4
37
23
33
24
21
9
2
32
25
22
III

DEVICE FOR LOCKING, IN ANY ONE OF THE NOTCHES OF A RACK, AN ADJUSTING FINGER AND ARMCHAIR EMPLOYING SAID DEVICE

FIELD OF THE INVENTION

The present invention relates to a device for locking, in any one of the notches of a rack belonging to one of the two mobile elements of a system, an adjusting finger belonging to the second mobile element.

BACKGROUND OF THE INVENTION

Such a combined rack and finger are generally intended to allow adjustment of the two elements with respect to each other, knowing that, in normal use, the stresses to which said elements are subjected, tend to maintain the finger engaged in the selected notch of the rack.

When the relative position of these elements is to be changed, the finger must be released from the notch of the rack used up to that moment, said elements must be displaced and the finger must be re-engaged in another notch which corresponds to the new position.

It is important to note that, during the change of position, the elements are free to move. In addition, such change is fairly often decided upon whilst the system is under load, with the result that the operation should be carried out after the system has been unloaded, taking care where one's hands are placed. In fact, if unloading is too rapid, reloading may be effected after release of the finger and/or its re-engagement, and this may then result in a deterioration of the rack; in addition, through lack of attention, a hand may be located between the mobile elements during the manoeuvre and if said released elements move together energetically during reloading, the hand may be pinched and injured.

It is an object of the present invention to overcome these drawbacks by proposing a locking device which maintains the finger in the selected notch of the rack, whether the system is under load or completely relieved, and which can be neutralized only when said system is unloaded and thanks to a manoeuvrable positive control, at a sufficient distance from the mobile elements to avoid one's hand being pinched.

SUMMARY OF THE INVENTION

To that end and in accordance with the invention, the first mobile element bearing the rack defines windows for the passage of retractable stops capable of being placed opposite the notches in order to stop the finger and prevent it from joining another notch, these stops being located at the free ends of flexible arms inclined in herringbone fashion and integral at their other ends with a sliding element guided in translation relatively to said first element and said stops being shaped as cams provided to provoke, by cooperating with an edge of the windows, the elastic bending of the arms during the controlled translation of the sliding element and thus the retraction of the stops, the elastic return of the arms provoking translation in the opposite direction of said stops which rest on another edge of said windows to stop the finger.

Such a known system incorporating rack and adjusting finger is used in various equipment and in particular in foldable and adjustable armchairs. Two racks may be added to or moulded with the two sides of the seat or the backrest or on the two sides of the supporting frame.

In particular, the device of the invention may be applied to an armchair comprising, on the one hand, a seat of which the two side elements comprise racks, and, on the other hand, a backrest extended by two front legs which comprise fingers cooperating with said racks, these front legs being articulated, as crossed supports, on rear legs, themselves articulated at their upper ends on the side elements of the seat, armrests being in addition articulated on the backrest and on arms themselves articulated on the seat.

In this particular application and according to the invention, the two series of stops combined with the racks belong to a monolithic locking piece disposed beneath the seat and U-shaped, its lateral parts constituting two sliding elements of the abovementioned type provided with inclined arms bearing said stops, whilst its median part comprises a manoeuvring handle and at least one end-of-stroke stop element for retraction of the stops, which stop element is positioned relatively to a projection of the seat for the stops to be retracted but remain prisoner of the windows.

The flexible a rms of the two lateral parts of the locking piece advantageously present balancing catches in projection in the vicinity of the stops.

When the sitting person moves the armchair without getting up, the stops prevent the fingers from being released from the selected notches of the rack, being given that the inclined arms cause them to project by elastic return.

When this person wishes to alter the level of the seat or to fold the armchair, he/she must get up in order to be able to actuate the rear handle. By pulling thereon, he/she causes the inclined arms to bend and the stops retract, releasing the fingers; he/she may then raise the seat from the rear in order to disengage the racks vis-à-vis these fingers and change the angle of the crossed supports. The chosen level being adjusted, the person may release the handle, and, by elastic return of the inclined arms, the piece returns forwardly whilst the stops project again and lock the fingers in the new notches selected.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
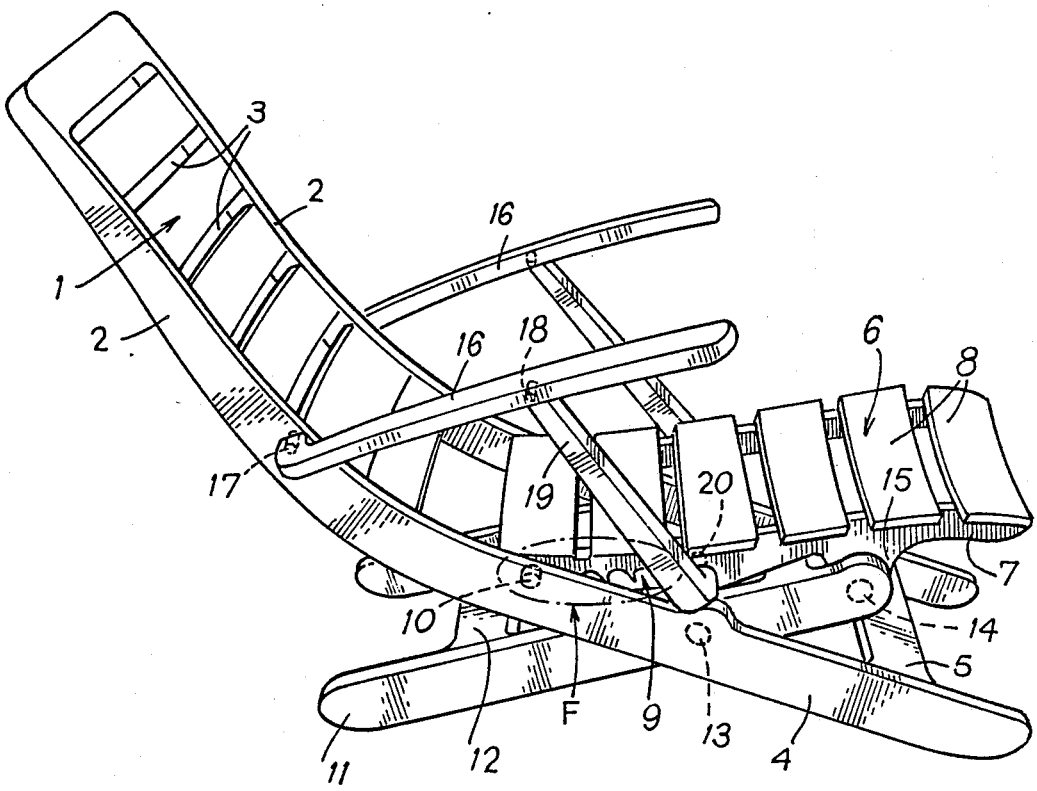
FIG. 1 is a perspective view illustrating an armchair in low position to which the device of the invention may be applied.

Referring now to the drawings, and firstly to FIG. 1, the adjustable and foldable armchair is made of plastics material in the example chosen. It comprises:

a backrest 1 of which the side elements 2 connected together by slats 3 are extended downwardly in order to constitute front legs 4 connected together by a lower crosspiece 5;

a seat 6 of which the side elements 7 connected by slats 8 each define at the rear an outwardly open rack 9 and capable of cooperating selectively with a finger 10 projecting inwardly on the corresponding front leg 4;

rear legs 11 connected together by lower and upper crosspieces 12, each rear leg 11 being articulated about an intermediate pivot pin 13 on the corresponding front leg 4 and about an upper pivot pin 14 on an eye 15 of the corresponding side element 7 of the seat, armrests 16 articulated about rear pivot pins 17 on the side elements 2 of the backrest 1 and about front pivot pins 18 on arms 19, themselves articulated about pivot pins 20 o the side elements 7 of the seat 6.

Each rack 9 comprises notches 21, five in number in the embodiment shown, adapted selectively to receive the corresponding finger 10 to determine five positions of the armchair. The notches are open outwardly and downwardly to allow passage of the finger and one to the other. These notches are separated by small partitions 22 inclined from top-rear to bottom-front. The partitions are interrupted above a ramp 23 defining a longitudinal passage 24 in which the finger having escaped a notch and resting on said ramp may move to join another ramp. The ramp is itself interrupted opposite the rear notch in order to define an opening 25 through which the finger 10 may escape in order to disconnect the seat 6 relatively to the front legs 4 when the armchair is to be folded flat.

Figure 2:
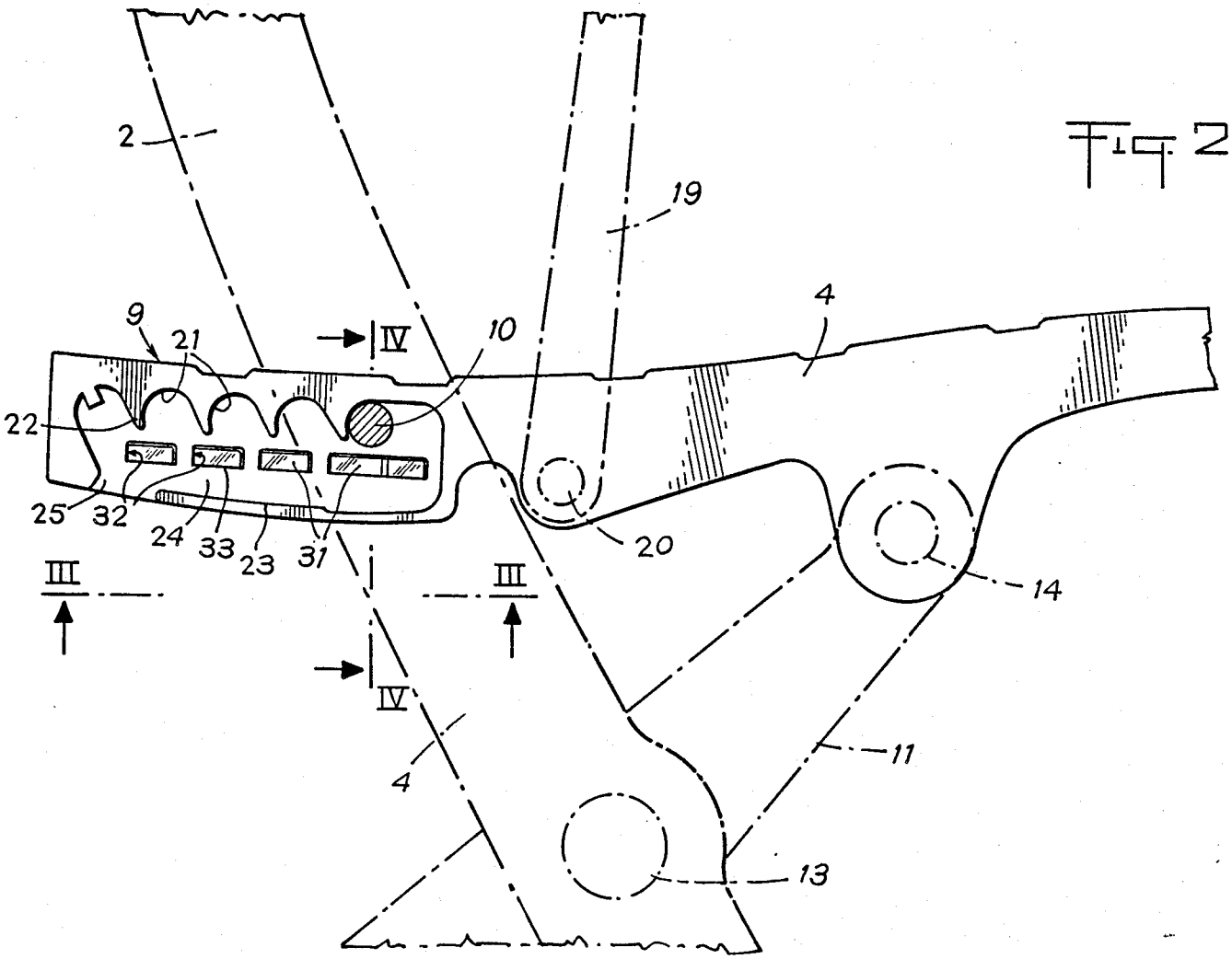
FIG. 2 is an elevation showing on a larger scale a detail of the armchair in high position designated in FIG. 1 by arrow F, this detail concerning the rack-finger system to which the device of the invention is applied.
Figure 3:
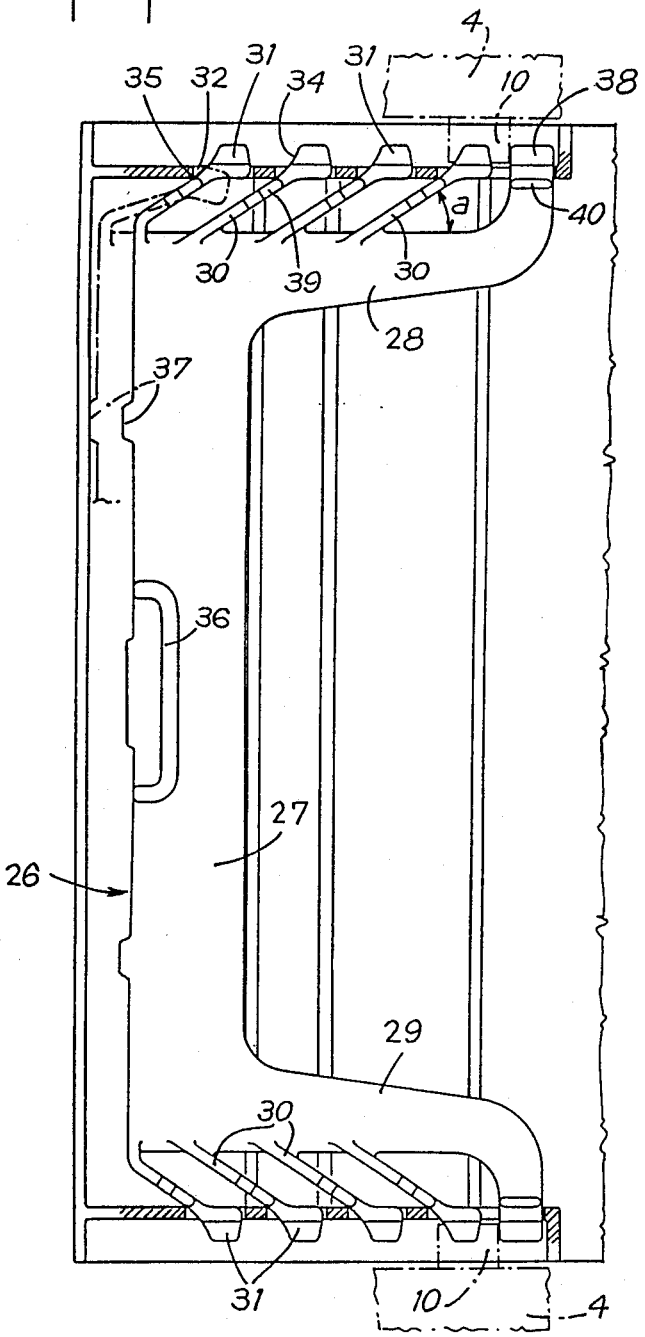
FIG. 3 is a plan view from underneath taken along the line III—III of FIG. 2.
Figure 4:
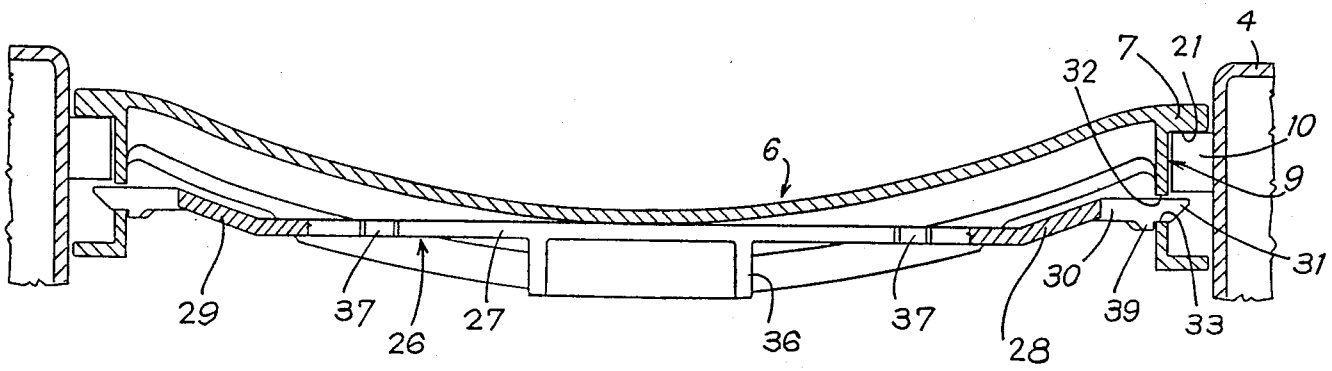
FIG. 4 is an elevation-section taken along line IV—IV of FIG. 2.

According to a particularly advantageous embodiment illustrated in FIGS. 2 to 4, the locking device is constituted by a single piece 26, preferably made of plastics material. Piece 26 is shaped as a U and disposed beneath the seat 6. Its median part 27 extends parallel to the slats 8 and its lateral parts 28 and 29 extend parallel to the side elements 7 of the seat.

Each of the lateral parts 28 and 29 is integral with flexible arms 30 inclined outwardly, from the rear to the front. The angle "a" formed by each arm with the edge of part 28 (or 29) which is parallel to the side element 7 is included between 20° and 45°; it is preferably equal to 34°.

These arms 30 of each of the lateral parts 28 and 29 are extended by stops 31 which traverse windows 32 made in the rack 9 combined with the relevant part. When piece 26 occupies its front rest position (in solid lines in FIG. 3), the arms 30 are relaxed and the stops 31 project beneath the notches 21 of the two racks. In the example shown, each lateral part comprises four arms, with the result that each arm is located opposite two notches of the corresponding rack. The distance of the stops 31 to the bottom of the notches 21 is slightly greater than the diameter of the corresponding finger 10 and as a result, if the seat 6 of the armchair is raised, this finger comes into contact with the or each stop 31 opposite and remains captive of the notch 21 in which it is housed, since the stops 31 rest on the lower edge 33 of the windows 32.

Furthermore, the rear edge 34 of each stop 31 is shaped as a cam in order to cooperate with the inner edge 35 of the rear edge of the conjugate window and to provoke by reaction, when piece 26 is displaced rearwardly, the bending of all the arms 30. In the example shown, the section of the cam 34 is incurved and concave.

The rearward displacement of piece 26 is controlled by the user by means of a handle 36 integral with the median part 27 of said piece. The effect of the bending of the arms 30 accompanying this rearward displacement of the piece 26 is to retract the stops 31 in the windows 32 (position shown in chaindotted lines in FIG. 3) and thus to release the finger 10 which may then be transferred from one notch 21 of the rack 9 towards another or be extracted through opening 25.

However, stops 31 remain captive in the windows, being given that stop elements 37 integral with piece 26 determine the end-of-rearward stroke position, by contact with an edge of the rear slat 8 of the seat.

As soon as the user releases handle 36, the arms 30 tend, by elastic return, to return piece 26 forwardly and to cause the stops 31 to project beneath the notches 21 of the rack 9. Consequently, the fingers 10 are automatically locked in the selected notches. The end-of-forward stroke position is determined by square extensions 38 of the lateral parts 28 and 29 of piece 26.

Furthermore, arms 30 present, projecting downwardly, near stops 31, catches 39 and, similarly, the extensions 38 present projecting catches 40. All these catches 39 and 40 make it possible, by contact with the side elements 7 of the seat, to balance the projection of stops 31 on both sides when piece 26 occupies the front position. Catches 39 and 40 are preferably rounded.

The foregoing description shows that the two lateral racks 9 of the armchair may now be used in complete safety thanks to the locking device, and this during adjustments and during the long periods without adjustment. Moreover, this considerable improvement may be obtained at a modest cost since the locking piece is monolithic and may be made by moulding a plastics material; in addition, its use requires only a slight modification of the side elements of the seat which, in any case, are moulded.

Of course, the essential part of the locking device is located in the vicinity of each rack, the U-shaped piece 26 not being indispensable. Consequently, the flexible arms 30 bearing the stops 31 may be integral with a sliding element which corresponds to part 28 or 29, but which is independent. In that case, the sliding element is guided in translation in a limited stroke, relatively to the element provided with the rack and is equipped with a positive control member such as a handle.

What is claimed is:

1. In a device for locking, in any one of the notches of a rack belonging to one of the two mobile elements of a system, an adjusting finger belonging to the second mobile element, the first mobile element defines windows for the passage of retractable stops capable of being placed opposite the notches in order to stop the finger and prevent it from joining another notch, these stops being located at the free ends of flexible arms inclined in herringbone fashion and integral at their other ends with a sliding element guided in translation relatively to said first element and said stops being shaped as cams provided to provoke, by cooperating with an edge of the windows, the elastic bending of the arms during the controlled translation of the sliding element and thus the retraction of the stops, the elastic return of the arms provoking translation in the opposite direction of said stops which rest on another edge of said windows to stop the finger.

2. The device of claim 1, wherein the cam section of each stop is incurved and concave.

3. The device of claim 1 or 2, wherein the angle formed by each arm with the sliding element is included between 20° and 45° and is preferably equal to 34°.

4. The device according to claim 1, applied to an armchair comprising, on the one hand, a seat of which two lateral elements comprise racks, and, on the other hand, a backrest extended by two front legs which comprise fingers cooperating with said racks, these front legs being articulated, in the manner of crossed supports, on rear legs, themselves articulated at their upper ends on the side elements of the seat, armrests being in addition articulated on the backrest and on arms, themselves articulated on the seat, wherein the two series of stops combined with the racks belong to a monolithic locking piece disposed beneath the seat and shaped as a U, its lateral parts constituting two sliding elements of the above-mentioned type provided with inclined arms bearing said stops, whilst its median part comprises a maneuvring handle and at least one end-of-stroke stop element for retraction of the stops, which stop element is positioned relatively to a projection of the seat so that the stops retract but remain captive in the windows.

5. The device according to claim 2, applied to an armchair comprising, on the one hand, a seat of which two lateral elements comprise racks, and, on the other hand, a backrest extended by two front legs which comprise fingers cooperating with said racks, these front legs being articulated, in the manner of crossed supports, on rear legs, themselves articulated at their upper ends on the side elements of the seat, armrests being in addition articulated on the backrest and on arms, themselves articulated on the seat, wherein the two series of stops combined with the racks belong to a monolithic locking piece disposed beneath the seat and shaped as a U, its lateral parts constituting two sliding elements of the above-mentioned type provided with inclined arms bearing said stops, whilst its median part comprises a maneuvring handle and at least one end-of-stroke stop element for retraction of the stops, which stop element is positioned relative to a projection of the seat so that the stops retract but remain captive in the windows.

6. The device according to claim 3, applied to an armchair comprising, on the one hand, a seat of which two lateral elements comprise racks, and, on the other hand, a backrest extended by two front legs which comprise fingers cooperating with said racks, these front legs being articulated, in the manner of crossed supports, on rear legs, themselves articulated at their upper ends on the side elements of the seat, armrests being in addition articulated on the backrest and on arms, themselves articulated on the seat, wherein the two series of stops combined with the racks belong to a monolithic locking piece disposed beneath the seat and shaped as a U, its lateral parts constituting two sliding elements of the above-mentioned type provided with inclined arms bearing said stops, whilst its median part comprises a maneuvring handle and at least one end-of-stroke stop element for retraction of the stops, which stop element is positioned relatively to a projection of the seat so that the stops retract but remain captive in the windows.

7. The device of claims 4, 5, or 6 wherein the flexible arms of the two lateral parts of the locking piece present, near the stops, balancing catches in projection.

8. The device of claim 7, wherein the catches are rounded.

9. The device of claim 4, wherein the free ends of the lateral parts of the locking piece comprise square extensions each remaining constantly engaged in the last window of the corresponding first side element.

10. The device of claim 7, wherein the free ends of the lateral parts of the locking piece comprise square extensions each remaining constantly engaged in the last window of the corresponding first side element.

* * * * *